United States Patent [19]

Dolata

[11] Patent Number: 4,649,683

[45] Date of Patent: Mar. 17, 1987

[54] ENERGY SAVING AND ENDURANCE LOG FOR A LOG BUILDING

[76] Inventor: Gerald Dolata, 9544 Dolata La., Box 185, Krakow, Wis. 54137

[21] Appl. No.: 778,998

[22] Filed: Sep. 23, 1985

[51] Int. Cl.[4] ..... E04B 1/10

[52] U.S. Cl. ..... 52/233; 52/726

[58] Field of Search ..... 52/233, 582, 586, 726; 446/106, 111, 112

[56] References Cited

U.S. PATENT DOCUMENTS

| | | | |
|---|---|---|---|
| 2,130,231 | 9/1938 | Forciea | 52/233 |
| 3,460,301 | 8/1969 | Davis | 52/233 |
| 3,936,987 | 2/1976 | Calvin | 52/586 X |
| 3,969,859 | 7/1976 | Hisey | 52/726 X |
| 4,279,108 | 7/1981 | Collister | 52/233 |

*Primary Examiner*—J. Karl Bell

*Attorney, Agent, or Firm*—Edwin E. Greigg

[57] ABSTRACT

An energy saving and endurance log system for a log building in which each log is provided with a weather shield for abutting end joints and are provided with a longitudinal drip shield that extends down over a portion of an adjacent lower log to prevent weather and moisture from entering the connection between adjacent logs. A vertical support extends down through centered holes from the rafters to the foundation to which the rafters are connected and which provide added strength to the walls formed by the logs.

20 Claims, 6 Drawing Figures

ENERGY SAVING AND ENDURANCE LOG FOR A LOG BUILDING

The invention relates to building logs for construction of log buildings and more particularly to a log construction which protects against moisture and provides added insulation for protection against the weather.

It is well known in the log building industry that logs are prepared by removing the bark and that the logs are usually laid upon one-another in a longitudinal superposed relationship. It is also well known that logs used have a great tendency to twist and shrink as the weather changes and or the logs dry out. Such twisting and shrinking usually causes cracks and openings to occur between the logs and or caulking used during the construction and in years to come.

It is therefore an object of the present invention to provide a log structure that prevents cracks to appear while drying out and during years to come.

Another object is to provide a log structure which prevents moisture from creeping between the logs as well as between the ends thereof which keeps the insulating materials dry.

Still another object is to provide a log structure that increases the insulation R-factor between the logs corners and the butt ends of the logs.

Yet another object is to provide means which adds strength to walls formed by logs and more positively relates the roof supports to the walls and foundation.

Other objects will become obvious and the invention will be better understood when related to the following drawings wherein.

Figure 1:
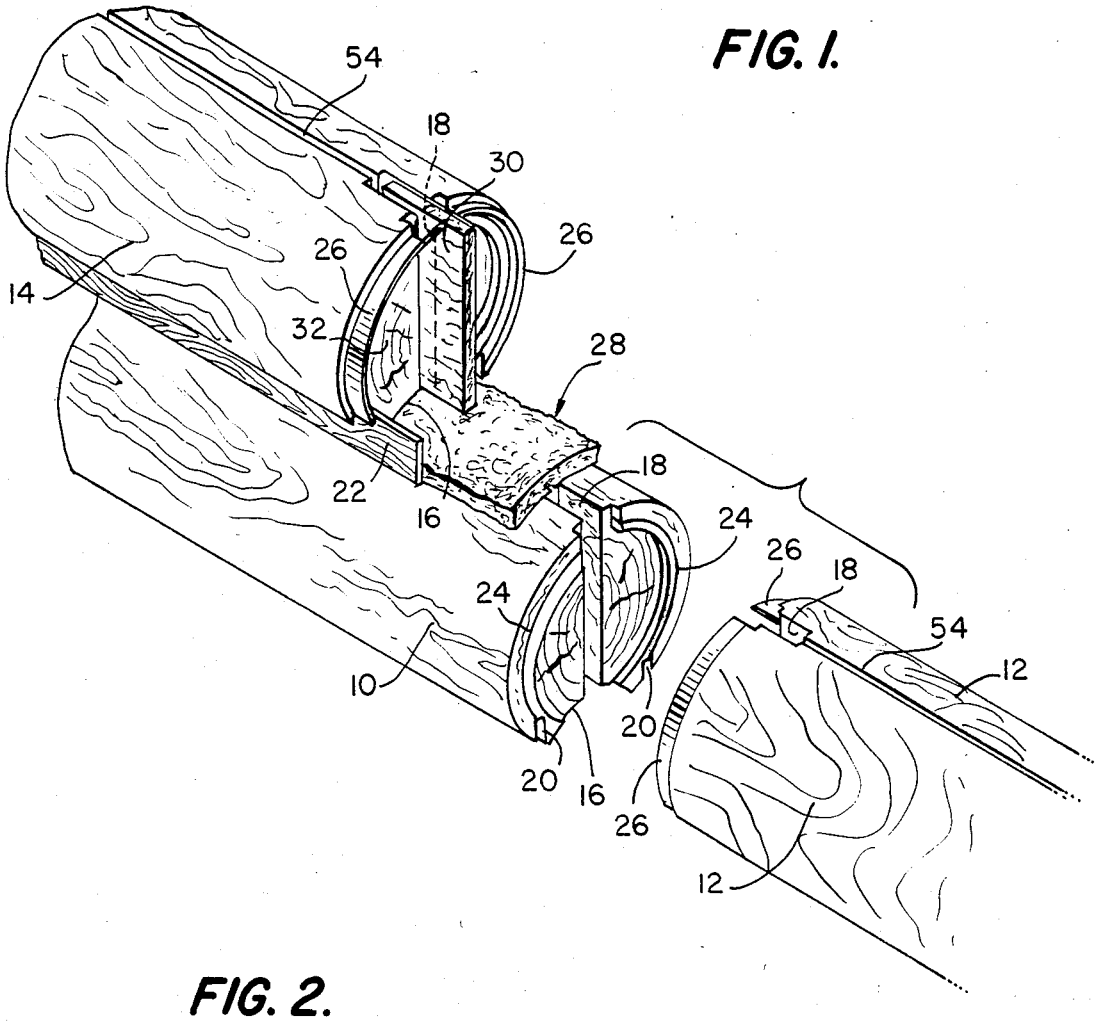
FIG. 1 illustrates a pair of logs laid end-to-end without full weather protection features with a log structure thereon that shows even further weather protection elements in accordance with this invention.

FIG. 1 illustrates three logs 10, 12 and 14 such as are assembled with their butt ends facing each other such as shown by logs 10 and 12 and with their lower and upper surfaces facing each other such as shown by logs 10 and 14. As shown more clearly by logs 10 and 14, the bottom surface of each log is formed to have a concave shape 16. The bottom concave surface by one log (14) is shaped to substantially conform with the upper surface of the log (10) upon which it is assembled. The butt ends of each log are provided with a central end slot 18 that extends from the upper surface down through the midpoint of the concave bottom surface. The length of each log is provided with a vertically extending longitudinal slot 20 which parallels the slot 18 into which a drip shield 22 is placed. The butt ends of each log are provided with arcuate grooves 24 near their outer surfaces which extend from adjacent to slot 18 down to longitudinal slot 20 such that the groove is to the outside of the drip shields 22. The circular section grooves 24 have placed therein thin plastic weather shields 26 which may be fixed in place by any suitable caulking to prevent any moisture from entering the butt ends when the logs (10 and 12) are assembled together. The bottom edge of the weather shields are outside of the drip shields 22. In order to provide further insulation, a strip of insulation 28 may be placed between the concave surface bottom of the upper log (14) and the upper surface of the adjacent lower log 10 as shown in FIG. 1. The insulation should extend along the length of the logs.

Figure 2:
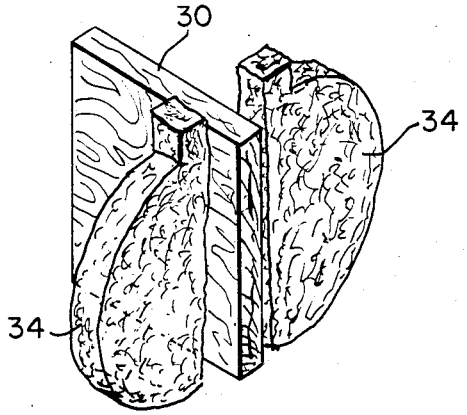
FIG. 2 illustrates a splice block that joins two butt ends together with insulation between the butt ends shown.

FIG. 2 illustrates a splice block 30 which is inserted into the slots 18 in adjacent butt ends when the logs are assembled. The butt ends of the logs are cut out to form a central circular section 32 inwardly of the drip shields into which poured foam 34 or any other type of caulking or insulation may be inserted between the butt ends with poured foam insulation around open space where splice block 30 has been set in giving strength and increasing the "R" factor at the butt splice.

The butt ends of log 10 has been shown with the slots 18, 20 and 24 therein without the splice block 30, drip shield 22, and the weather shield in place for clarification of the drawings. The drip shield and weather shield has been shown in the butt end of log 14 without designating the longitudinal slots 20 and end grooves 24. The splice block has been shown in place in FIG. 3.

Figure 4:
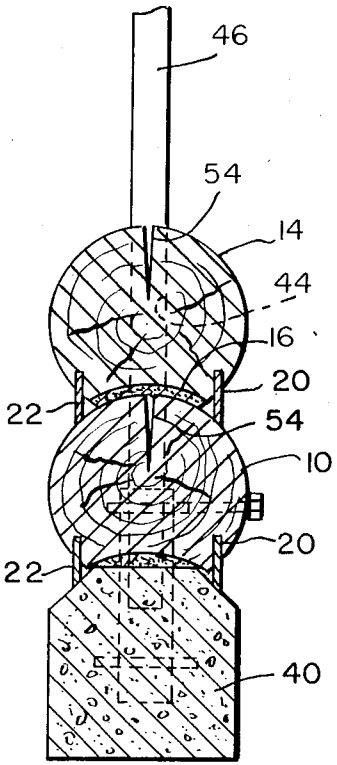
FIG. 4 illustrates an end view of the logs such as shown in FIG. 3.
Figure 3:
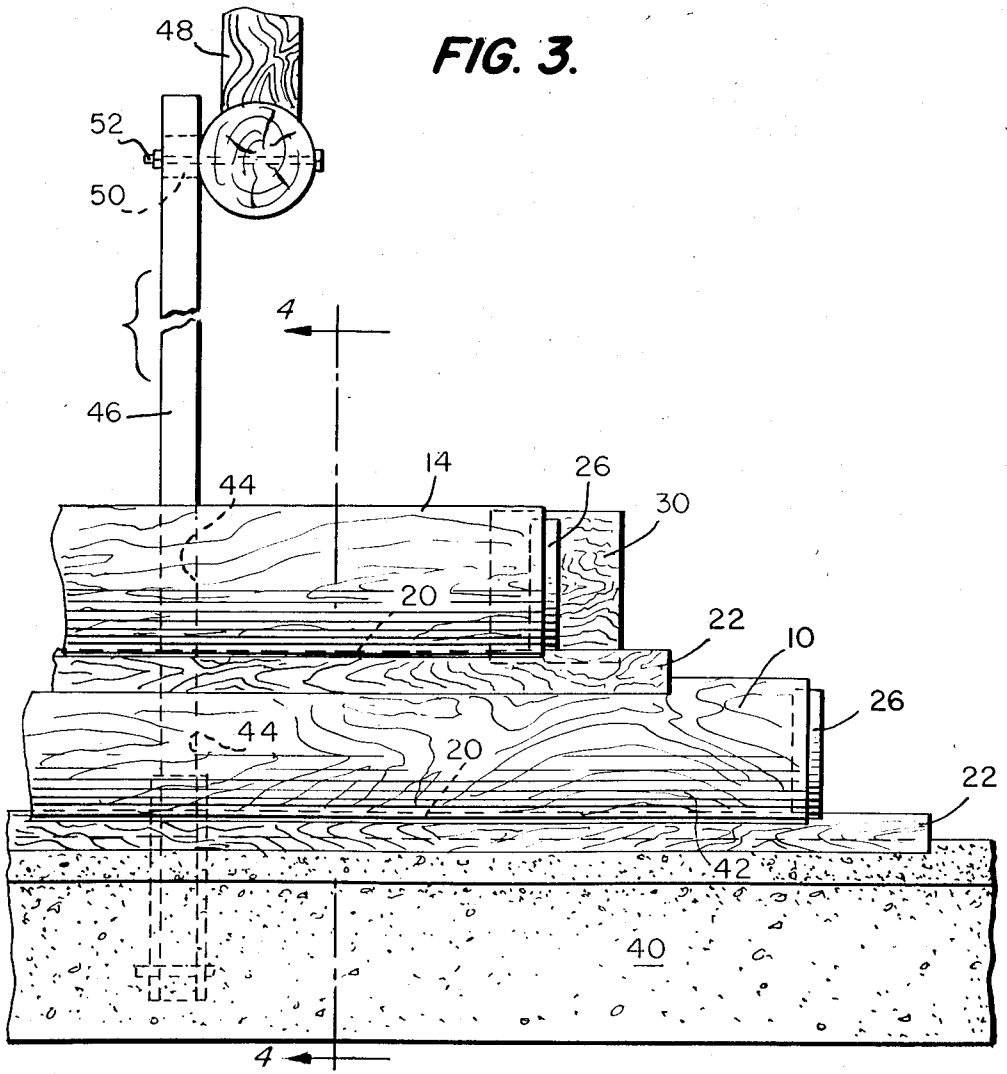
FIG. 3 illustrates a side view of logs assembled on a foundation.
Figure 5:
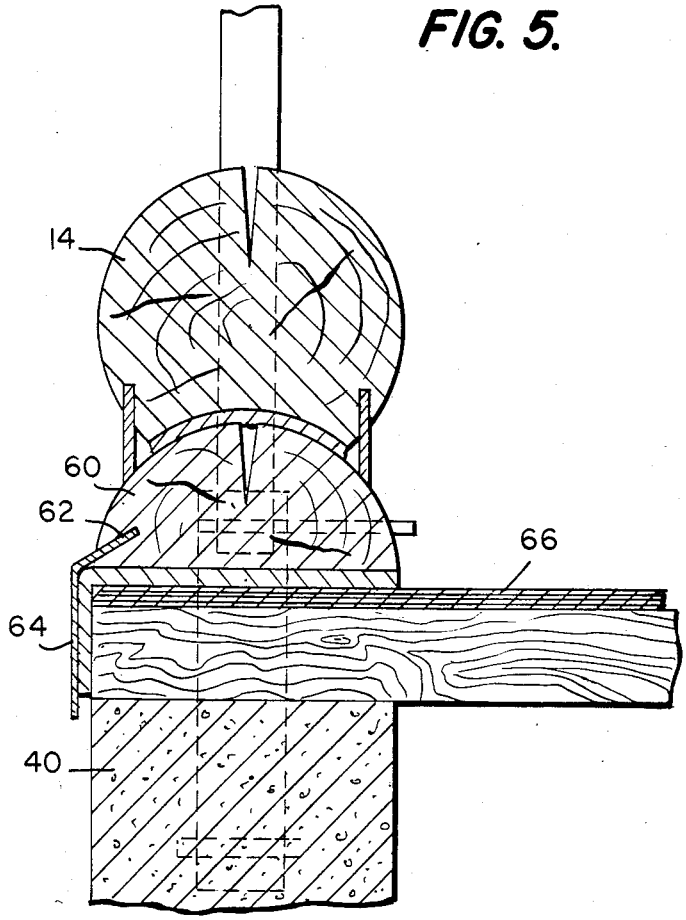
FIG. 5 illustrates one wall surface as related to a "ground" floor.

FIGS. 3 and 4 illustrate a side view and an end view of a foundation 40 with a log 10 assembled onto the foundation. The sides and butt end of log 10 are provided with slots, grooves, drip shields and weather shields as set forth for the log 10 to protect its connection.

As shown in FIGS. 3 and 4, the logs are provided with vertically extending centerlined holes 44 into which a vertical support 46 is placed. The vertical support 46 is secured to the foundation at its bottom and the roof rafters 48 are secured to the upper end of the vertical support. The upper end of the vertical support is provided with a vertically extending linear slot 50 through which a bolt 52 connected to the roof rafter 48 may extend by which the roof rafter may be adjustable along the length of the slot. It is obvious that a plurality of such supports 46 will utilize the structure by tieing together the roof, walls and foundation. The vertical support adds strength to the walls and also aids in preventing twisting of the logs during drying during weather changes.

FIG. 4 further shows a longitudinal cut 54 along the length of the upper surface of the log which cut also relieves the stresses and strains of the log during drying and also helps prevents unsightly cracks elsewhere and acts as a barrier against heat or cold conduction.

It is to be noted that the weather shield extends down to the outside of the drip shield therefore any dripping from the weather at the butt joint will be to the outside of the drip shield. Therefore, the drip shield also protects the butt joint. The slots in which the drip shield are placed are wider horizontally than the drip shield so that the drip shield will be loose within the slot. The drip shield is applied, leaving a small space at the top of the slot in which it is inserted to leave room for shifting. Also, the splice block is loose in the slot in the butt end. Since these are loose in their slot, the looseness allows for twisting and shrinking during drying and weather changes. The edge of the drip shield that extends down over the surface of the adjacent log is secured thereto by rustproof nails, therefore, the upper edges of the drip shields are free to move within the slots 20 whereas the bottom edge is fixed to the adjacent log. Also, since there is space between the drip shield and the log, the space functions as additional insulation by forming an air pocket may also be used to run electrical wires.

Obviously, the drip shield can be placed on both sides of the log which will further add to the insulation factor. If one desired to add to the expense of building the log building, an insulation may be added between the drip shield and the log for additional insulation. The drip shield and weather shield will then protect whatever insulation is provided between the butt ends and between the drip shields and the logs. Not only do the drip shield and weather shields protect the logs against the weather, they also increase the R-factor of the insulation.

In assembly of the logs it is well known that the ends of the logs that form adjacent walls cross-over each other which interlock the ends of the logs. In order to cross-over each other at their ends, the bottom surface of each log at the surface of each log at the cross-overs is notched out to the mid-plane so that the bottom surface of an overlying log will have a close fit with the upper surface of the adjacent log. Further, in order to form walls that lie closely adjacent the foundation, two parallel walls must have a half-log 60 adjacent the foundation which allows the cross-over logs of the other two walls to cross-over the half-logs and to lie closely adjacent to the foundation. The exposed side of the half-log is provided with a slit 62 along its length in which a metal shield 64 is placed and which extends down over the foundation.

In construction of the log house, the "ground" floor 66 could be constructed on the foundation and the logs would be assembled above the "ground" floor construction on the foundation and the metal shield 64 would extend down over the floor and a portion of the foundation.

Figure 6:
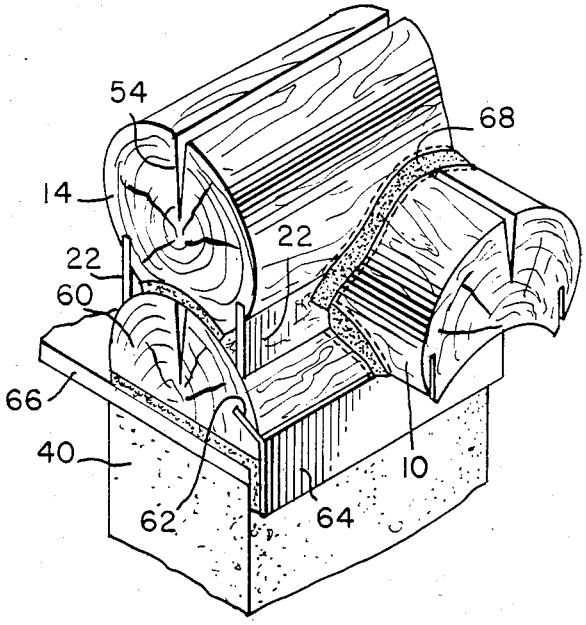
FIG. 6 illustrates a corner construction.

In order to increase the R-factor of the insulation, and to protect the insulation, plastic or any other suitable shields can be formed between the logs at their cross-over. Such shields will provide insulation and also prevent the rain and or snow from entering the area between the cross-over ends of the logs such as seen in FIG. 6.

The logs have been shown with a slit 54 along their top. This slit also extends out from the interlocking ends and is exposed to the weather. The exposed slits could be protected by a shield or poured foam which would prevent the weather from entering the slit.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A log for construction of a log building which comprises:

an elongated peeled log of substantially uniform diameter along its length with parallel end faces, a bottom surface of said log having a concave surface configuration centered on a diametrical line of said log, a rounded top surface directly opposite from said concave bottom surface which mates with a concave surface of another log when placed upon said rounded top surface, a vertically extending longitudinal slot in the top surface of said log that extends the length of said log, a vertically extending longitudinal slot along at least one side of said log with said slot extending vertically substantially parallel with said diametrical line with said slot being formed outwardly of said concave surface, said log including at least one butt end, said butt end including an end slot along said diametrical line which extends from a top of said log down through said butt end to said concave surface; and said butt includes at least one short, longitudinally extending arcuate groove near an outer surface of said log which extends from a line juxtaposed said end slot down to said at least one longitudinal slot in said log.

2. A log as claimed in claim 1, in which said at least one butt end has a cylindrical portion radially inwardly of said arcuate groove removed to form a cylindrical recess within said butt end.

3. A log as claimed in claim 1, which includes:

a drip shield for insertion into said vertically extending longitudinal slot in said log, said drip shield extending downward from said slot such that said shield extends along an outer surface of a log upon which said log with said drip shield rests when forming a log building.

4. A log as claimed in claim 3, which includes:

a weather shield for insertion in said at least one arcuate groove in said at least one butt end of said log.

5. A log as claimed in claim 3, which includes:

a splice block for insertion into said end slot of said at least one butt end of said log.

6. A log as claimed in claim 4, which includes:

a splice block for insertion into said end slot of said at least one butt end of said log.

7. A log as set forth in claim 1, in which:

said log includes a vertically extending longitudinal slot on opposite sides of said log each of which are substantially parallel with said dimetrical line and each other.

8. A log as set forth in claim 7, which includes:

a drip shield for insertion into said longitudinal slots on opposite sides of said log, said drip shield extending downward from said slot such that said shield extends along an outer surface of a log upon which said log with said drip shield rests when forming a log building.

9. A log as set forth in claim 8, which includes:

two short longitudinally extending arcuate grooves each of said grooves being near opposite outer surfaces of said butt end of said log.

10. A log as claimed in claim 9, which includes:

a drip shield for insertion into each of said two arcuate grooves in said butt end of said log.

11. A log as claimed in claim 10, which includes:

a splice block for insertion into said end slot of said at least one butt end of said log.

12. A log as claimed in claim 11, in which:

said log has two butt ends.

13. A log as claimed in claim 11, in which:

said at least one butt end has a cylindrical portion radially inwardly of said arcuate grooves removed to form a cylindrical recess within said at least one butt end.

14. A log as claimed in claim 13, in which:

said log has two butt ends.

15. A method of preparing a skinned log having parallel ends for assembly of a log building and method of assembly which comprises:

forming a concave bottom surface on said log with the concave surface centered on a diametrical line through said log, forming a vertically extended longitudinal slot along at least one side of said log with said slot formed outwardly of said concave surface and substantially parallel with said diametrical line, forming an end slot in each end of said log with the slot along said diametrical line and extending from a top surface through a center line of said concave surface, forming at least one arcuate groove in each end of said log near the same outer surface with said arcuate groove extending from adjacent said end slot to said longitudinal slot, forming a splice block having a thickness less than said end slot, a height the same as said end slot and a length twice the depth of said end slot, positioning butt ends of two logs in end-to-end relationship above previously laid logs with the concave surface juxtaposed a top surface of said laid logs, securing one end of a weather shield in said arcuate groove formed in one end of said butt ends of said end-to-end logs, moving one log toward the other log so that said weather shield is inserted into said arcuate groove of said butt end in which said weather shield is not secured, securing said splice block in said end slots of the butt ends of each log in end-to-end relationship, and;

inserting a drip shield into said longitudinal slot such that said drip shield extends downward alongside a portion of a log upon which said log with said drip shield rests to form a log building and securing said drip shield to said logs upon which said end-to-end logs are positioned.

16. A method as set forth in claim 15, in which a strip of insulation is placed between the top surface and bottom concave surface of adjacent logs.

17. A method as set forth in claim 16, which includes injecting an insulation material between said end-to-end butt ends.

18. A method as set forth in claim 16, which includes injecting insulation between said drip shield and said logs.

19. A method as set forth in claim 15, which includes drilling vertical holes along said diametrical line so that said holes are centered on each other for receiving a support for supporting the rafters.

20. A method as set forth in claim 14, which includes forming a half-log for parallel sides, forming longitudinal slit in said half-log, placing a shield in said longitudinal slit in said half-log so that said shield extends down over a portion of a foundation and;

forming a corner shield between interlocking crossover ends of said logs when assembled into a building.

* * * * *